US005107176A

United States Patent [19]

Endo et al.

[11] Patent Number: 5,107,176

[45] Date of Patent: Apr. 21, 1992

[54] PLASMA DISPLAY DEVICE

[75] Inventors: Takafumi Endo; Hiroshi Ito; Hironobu Arimoto, all of Hyogo, Japan

[73] Assignee: Mitsubishi Denki Kabushiki Kaisha, Tokyo, Japan

[21] Appl. No.: 459,291

[22] Filed: Dec. 29, 1989

[30] Foreign Application Priority Data

Jun. 12, 1989 [JP] Japan ..... 1-146758

[51] Int. Cl.[5] ..... H01J 17/49

[52] U.S. Cl. ..... 313/583; 313/581; 313/582

[58] Field of Search ..... 313/583, 582, 584, 586, 313/51, 495, 496, 493; 340/758, 759, 774, 718, 719, 771, 815.2; 315/169.4

[56] References Cited

U.S. PATENT DOCUMENTS

| | | | |
|---|---|---|---|
| 3,944,868 | 3/1976 | Kupsky | 313/517 |
| 4,039,882 | 8/1977 | Kupsky et al. | 313/583 |
| 4,206,382 | 6/1980 | DuBois | 313/496 |
| 4,289,364 | 9/1981 | Strom et al. | 313/583 |
| 4,386,293 | 5/1983 | Waldron | 313/583 |
| 4,727,287 | 2/1988 | Aida et al. | 313/582 |

FOREIGN PATENT DOCUMENTS

| | | | |
|---|---|---|---|
| 0143548 | 7/1985 | Japan | 313/586 |
| 2155229 | 9/1985 | United Kingdom . | |

OTHER PUBLICATIONS

N. Sato et al., *Proceedings of the SID*, "LSI-Direct-Controlled Plasma Display Panel", vol. 16, No. 2, Los Angeles, U.S., pp. 85-88, 4/1975.

*Primary Examiner*—Donald J. Yusko
*Assistant Examiner*—Nimeshkumar D. Patel
*Attorney, Agent, or Firm*—Rothwell, Figg, Ernst & Kurz

[57] ABSTRACT

A plasma display device is provided with one substrate having a plurality of electrode drawing-out portions extending up to a side end thereof for applying an AC voltage to X side electrodes each independently, a second substrate having a plurality of electrode terminal portions formed independently on its electrode-disposed surface, the plural electrode terminal portions being electrically connected respectively to the plural electrode drawing-out portions by a connector portion. The connection of each of the X and Y electrodes with an external power source can thus be made on only the Y side electrode-disposed surface of the second substrate. Besides, the shape of the substrates is simplified.

2 Claims, 17 Drawing Sheets

PLASMA DISPLAY DEVICE

BACKGROUND OF THE INVENTION

1. Field of the Invention

The present invention relates to a plasma display device suitable for use as a computer terminal display device or a destination display device.

2. Description of the Prior Art

In a plasma display device, a plurality of linear electrodes are arranged in parallel and closely spaced on each of a pair of insulating plates formed by a transparent, hard material such as, for example, glass, both insulating plates being opposed to each other so that the linear electrodes cross perpendicularly in the form of a matrix through a thin discharge space, the outer peripheral portion being sealed hermetically and the interior being evacuated and filled with an inert gas such as neon. An AC voltage is applied between selected ones of the linear electrodes to cause gas discharge between the intersecting points of the electrodes, thereby forming a predetermined luminous display pattern.

FIGS. 1(*a*) and (*b*) are sectional views showing a conventional plasma display device, in which the numeral 1 denotes a front glass as a display surface of a conventional plasma display device; numeral 2 represents a row of long, thin, strip-like front electrodes arranged on an inner surface of the front glass 1; numeral 6 denotes a rear glass disposed in opposed relation to the front glass 1 at a predetermined spacing; numeral 5 represents a row of long, thin, strip-like rear electrodes arranged on an inner surface of the rear glass 6 so as to form a matrix together with the front electrode row 2; numeral 7 denotes a sealing glass provided along the outer periphery of the front glass 1 and that of the rear glass 6 to seal the display portion formed by both electrode rows hermetically from the exterior; numeral 13 denotes a flexible printed circuit (hereinafter referred to as "FPC") soldered to each of the front electrode row 2 of the front glass 1 and that of the rear electrode row 5 to connect the display portion electrically to an external drive unit; and numeral 14 denotes a driving IC which receives an external display signal and causes corresponding display cells to emit light.

The arrangement of such a conventional plasma display device will now be described. The front glass 1 serves as the display surface of the display device, and supports the front electrode row 2 comprising image or character information displaying electrodes. The end portion of glass 1 has the electrodes of the front electrode row 2 drawn out to the exterior. The rear glass 6 supports the rear electrode row 5 spaced apart from the front electrode row 2 in the form of a matrix. The end portion of glass 6 has the electrodes of the rear electrode row drawn out to the exterior. The front and rear glass plates are sealed hermetically by the sealing glass 7. The thus-sealed space between both glass plates is filled with an inert gas such as neon. The electrode end portions of the front and rear glass plates 1, 6 are drawn out of the sealing glass 7 and exposed, then connected to the FPC 13 by soldering or the like for conduction with an external power source. Further, the driving IC 14 for selecting an intersecting point of matrix electrodes in the plasma display device, is mounted on the FPC 13. A high voltage is applied between the thus-selected front and rear electrodes, so that the encapsulated gas discharges to emit light and the corresponding points on the panel become luminous to effect a display pattern.

In the above construction of the conventional plasma display device, the surface of the electrode end portions which serve as connections and which are drawn out and exposed to the exterior for connection with the driving IC 14 are disposed in the direction opposite to the display surface, that is, in opposed relation thereto. Further, since the electrodes constitute a matrix, it is necessary that such electrode end portions be drawn out in two directions. This causes restrictions in the electrical connection of many terminals. Also in sealing both front and rear glass plates hermetically, serious problems are involved such as three-dimensional portions, e.g. corner portions, being present in the connection of both glass plates. Further, since the electrode end portions serving as connecting portions extend out from both the front and rear glass plates, the shape of the display portion (panel portion) is restricted.

The spacing between the hermetically-sealed front and rear glass plates is determined by the thickness of spacers (ribs) 15 each interposed between adjacent electrodes of the front electrode row 2 or the rear electrode row 5 as shown in FIG. 2. The ribs 15, which are generally black, are provided to prevent the emission of light by discharge of gas at an intersecting point between the matrix electrodes from spreading to the other portions. By the abutment of the ribs 15 with the front and rear glass plates 1, 6 there is determined the spacing between both glass plates. The thickness of spacers 15 is determined by the amount of luminance emitted by discharge, the kind of gas sealed, etc. Usually, such spacing is set at 100 μm or so.

In order to obtain a rib thickness of about 100 μm, the present inventors repeated printing on a glass plate using a black glass paste and a No. 200 mesh screen. The film thickness obtained by a single printing-drying-calcining cycle was about 20 μm±5 μm. By repeating this cycle five times there could be obtained a thickness of about 100 μm.

FIG. 3 is a normalized graph of a scattered thickness state of the resulting film at the end of each printing-drying-calcining cycle. As shown therein, the scatter in film thickness is about ±15 μm at a resulting film thickness of about 100 μm. This scatter is caused by various factors, including the mesh mark in printing, non-registration in overlap printing and variations in the viscosity of paste. Consequently, the spacing between both glass plates varies with scattering in the thickness of the ribs 15. Thus, the scatter in thickness varies device by device, and even in a single plasma display device, there occurs difference in rib thickness at some particular points, so that the said spacing is not uniform. Since the luminance amount of the light emitted depends on the spacing between both glass plates, the emitted light luminance distribution in the conventional display device is non-uniform.

SUMMARY OF THE INVENTION

The present invention overcomes the abovementioned problems.

It is the first object of the present invention to provide a display device wherein the connection between the electrodes in the display portion and a power source for an external drive system, etc. can be done on a single surface.

It is the second object of the present invention to provide a plasma display device capable of effecting a hermetic seal between an internal space formed by both glass plates and the exterior in a superior and easy manner.

It is the third object of the present invention to provide a plasma display device wherein there are few restrictions on the shape of a display portion or the whole of the display device and which therefore has a lightly reliable display portion.

It is the fourth object of the present invention to provide a plasma display device wherein the spacing between electrode rows which form a matrix is made constant to give a uniform emitted luminance distribution characteristic.

It is the fifth object of the present invention to provide a method for producing a plasma display device having electrode leads which can ensure high accuracy easily and permit reduction in size and provide high reliability of the device.

It is the sixth object of the present invention to provide a plasma display device which can be easily produced and reduced in size and cost, while permitting easy production of its components and affording high reliability.

The above and other objects and novel features of the present invention will become clear from a reading of the following detailed description with reference to the accompanying drawings. It is to be understood, however, that the drawings are for illustration only, and are not intended to limit the scope of the present invention.

In order to attain the above-mentioned objects, in one embodiment of the plasma display device of the present invention, the electrode end portions of a row of electrodes arranged on a front glass are connected to a row of terminals separately arranged independently on a rear glass, whereby the connection between the electrode row on the front glass and that on the rear glass can be effected using only the rear glass electrode-disposed surface. Further, the shape of the display portion can be simplified without restrictions and sealing for both glass plates can be done on a single surface.

More specifically, in one embodiment of the plasma display device of the present invention, metallic leads connected to electrode ends of the front electrode rows are electrically connected to terminals independently provided for front electrodes on the rear glass, whereby all of the electrode connecting terminals for the selection of a display cell on the display portion can be disposed on the rear glass. Moreover, the front glass no longer juts out from the rear glass; that is, there can be attained simplification. Further, an electrode plate (a spacer member) for electrical connection between the front electrode ends and the terminals for the front electrodes provided separately on the rear glass is interposed between the front and rear glass plates, whereby the selection of all the display cells can be done from above the rear glass, and the said electrode plate is also allowed to serve as a spacer for ensuring the gap between both glass plates.

In order to achieve the foregoing objects, there is used a substrate having two stages, a row of electrodes is arranged on the lower-stage surface, while electrode terminals (patterns) are arranged on the upper-stage surface, and an electrode end portion of a separate, transparent substrate having another row of electrodes which intersect the electrode row arranged on the lower-stage surface to form a matrix, is connected electrically to the electrode terminals (patterns) on the upper-stage surface. Further, a discharging gas for the emission of light is sealed within the space between the substrate having two stages and the other transparent substrate hermetically, and a driving IC is mounted on the substrate upper stage side.

Thus, in the plasma display device of the present invention, the difference in height of the substrate having two stages is used to ensure the gap between the electrode rows which for a matrix, and is also utilized for hermetic seal. Further, the electrode terminals (patterns) on the upper-stage surface of the substrate having two stages are electrically connected to the electrode row on the transparent substrate, and an IC for driving the display portion is mounted on the substrate upper-stage surface.

According to the method for producing the plasma display device of the present invention, moreover, in order to achieve the foregoing objects, there can be produced electrode leads capable of easily and positively connecting between electrode ends of the front electrode row and a row of terminals for the front electrode row provided on the rear glass.

More specifically, in the plasma display device producing method of the present invention, a plate of oxygen-free copper, brass or kovar having a certain thickness is etched in the form of a long, thin strip in accordance with the pitch of a row of electrodes, then the resulting leads in the form of a long, thin strip are plated with nickel, silver, or an alloy thereof. By using the metallic leads thus produced there can be performed electrical connection of electrode ends easily and positively. For the connection of the metallic leads, silver terminals are provided near the end portion of a metallic pattern of an electrode row, then silver paste is printed on the upper surface of the silver terminals, and in a vicious state of the silver paste the metallic leads are pressed and connected to the silver terminals, followed by calcining to effect connection between the electrode row and the metallic leads.

DETAILED DESCRIPTION OF THE PREFERRED EMBODIMENTS

Figure 1:
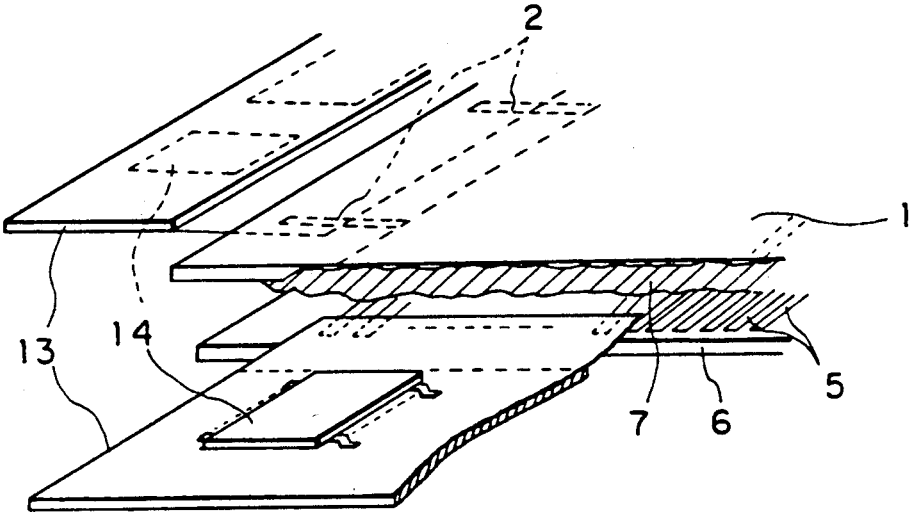
FIG. 1 (a) (PRIOR ART)
FIGS. 1(*a*) and (*b*) are a sectional perspective views showing a conventional prior art plasma display device.
Figure 1:
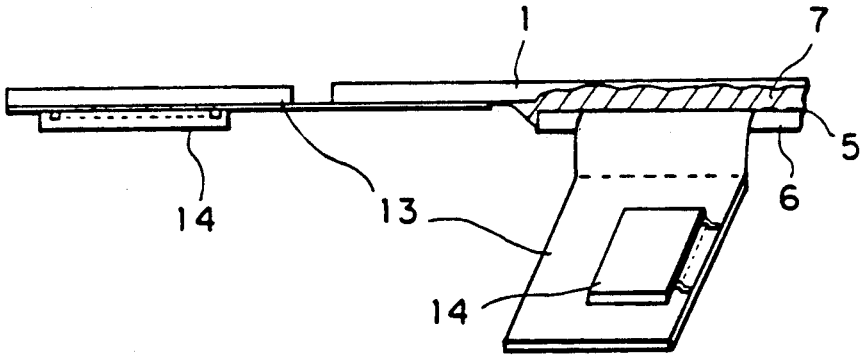
FIG. 1 (b) (PRIOR ART)
Figure 2:
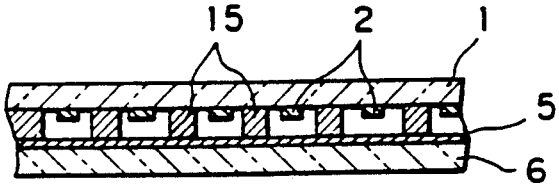
FIG. 2 (PRIOR ART)
FIG. 2 is a sectional side view of the device of FIG. 1(*a*) and (*b*).
Figure 3:
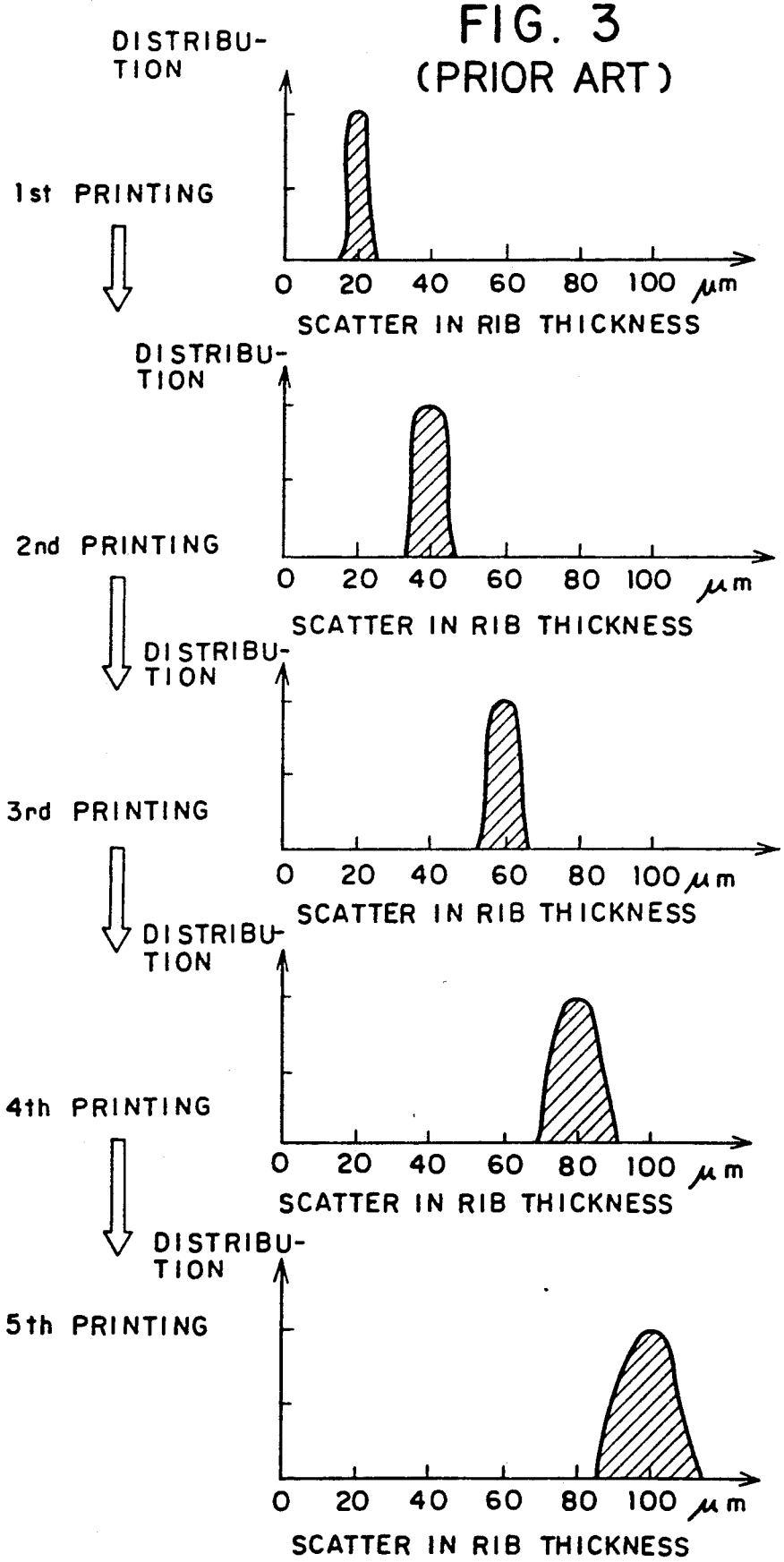
FIG. 3 (PRIOR ART)
FIG. 3 is a diagram showing how the rib thickness as the resulting film thickness scatters with repetition of printing.
Figure 4A:
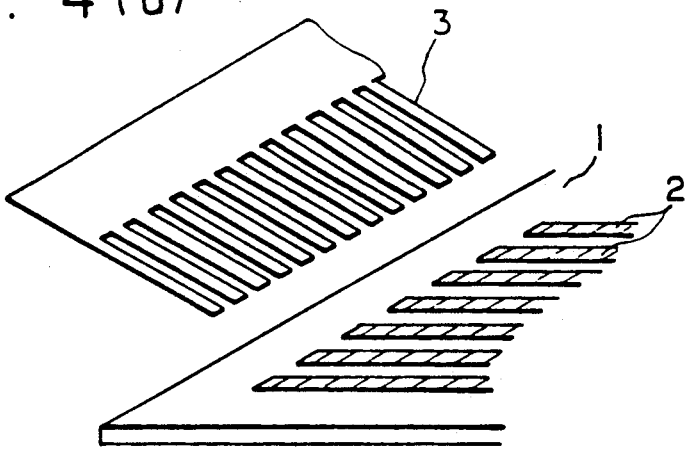
FIGS. 4(*a*),–(*e*) are fragmentary views showing a plasma display device according to an embodiment of the present invention.
Figure 4B:
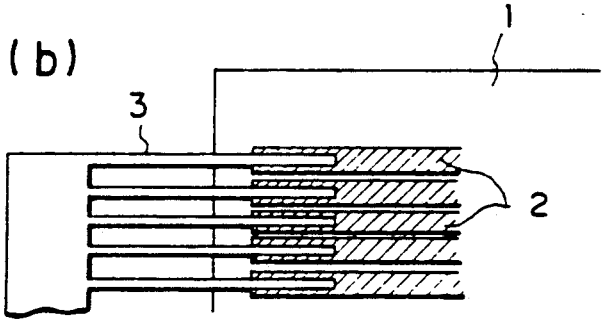
Figure 4C:
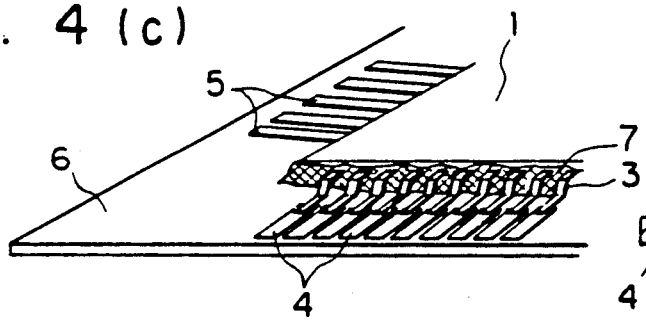
Figure 4D:
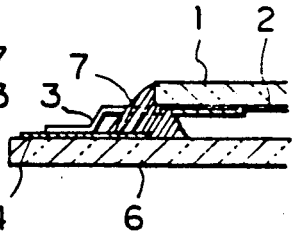
Figure 4E:
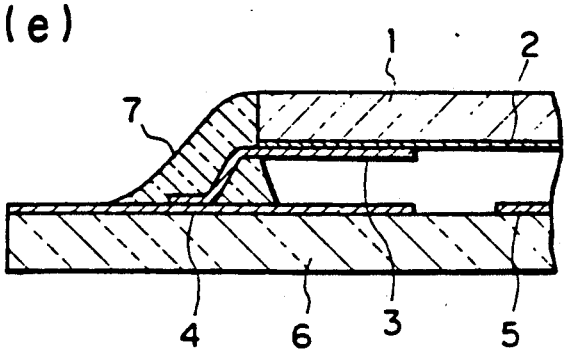
Figure 5A:
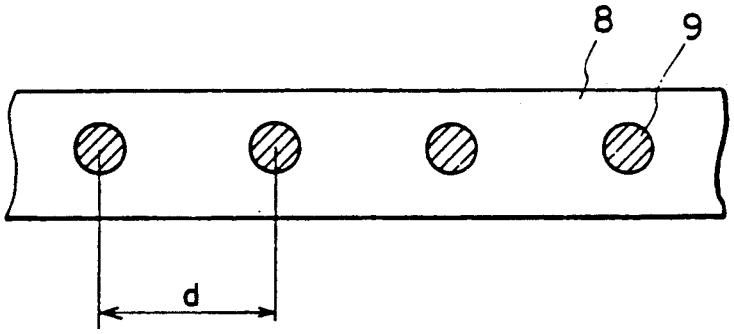
FIGS. 5(*a*)–(*d*) are fragmentary views showing a plasma display device according to a second embodiment of the present invention.
Figure 5B:
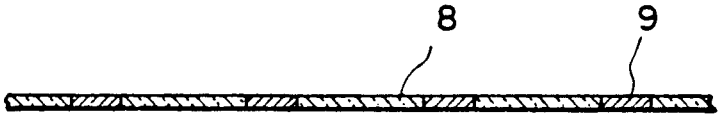
Figure 5C:
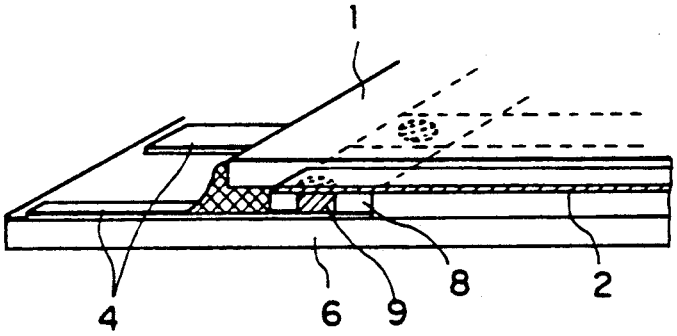
Figure 5D:
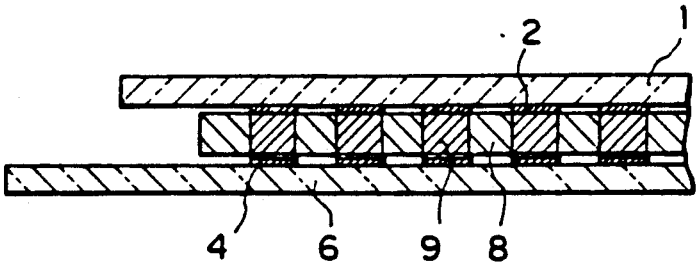

Preferred embodiments of the present invention will be described below in detail with reference to the accompanying drawings.

In FIG. 4(*a*) –(*e*), the numeral 1 denotes a front glass serving as a display surface of the display device; numeral 2 denotes a row of long, thin strip-like front electrodes arranged on one side of the front glass 1; numeral 3 denotes a row of metallic leads for interconnecting the electrodes of the front electrode row 2 with an external power source; numeral 4 denotes a connecting electrode row for bringing out the metallic lead row 3; numeral 6 denotes a rear glass opposed to the front glass 1 and separated by a predetermined spacing; numeral 5 denotes a rear electrode row disposed in the form of a long strip on one side of the rear glass 6 to form a matrix together with the front electrode row 2; and numeral 7 denotes a sealing glass provided along the outer periphery of the front glass 1 and that of the rear glass 6 to seal a display portion formed by both electrode rows hermetically from the exterior.

In FIGS. 5(*a*)–(*d*), the numeral 8 denotes a glass plate having through holes of the same pitch as the interelectrode pitch of the front electrode row, the glass plate 8 serving to determine the spacing between the front glass 1 and the rear glass 6 and maintain the insulation between both electrode rows. The through holes are located at the intersection points between the front and rear row electrodes. Numeral 9 denotes an electrically conductive material inserted into the holes of the glass plate 8 to allow electrical conduction between the upper and lower surfaces of the glass plate 8.

Figure 6:
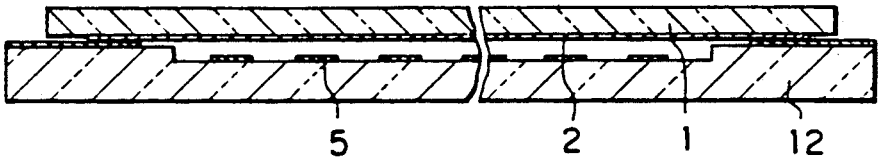
FIGS. 6(*a*), (*b*) and (*c*) are fragmentary views showing a plasma display device according to a third embodiment of the present invention.
Figure 6:
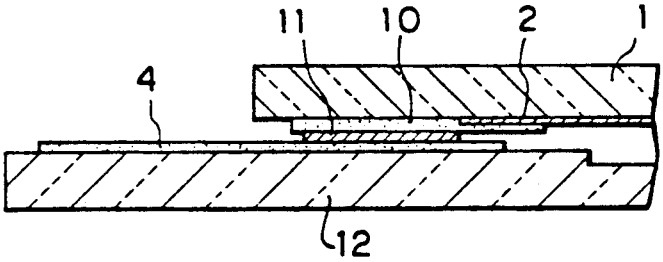
Figure 6:
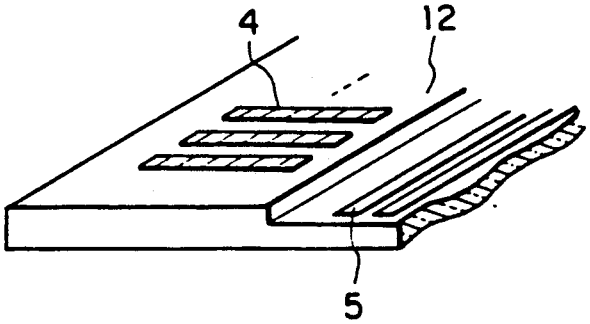

In FIGS. 6(*a*)–(*c*), the numeral 10 denotes a front connecting electrode row for reinforcing the front electrode row 2, and numeral 11 denotes a connecting electrically conductive material for electrical connection between the connecting electrode row 4 and the front connecting electrode row 10.

The arrangement of the embodiments of FIGS. 4(*a*)–(*e*) will now be described. The front electrode row 2 is drawn out to the exterior of the front glass 1 by connecting the metallic lead row 3 to the front electrode row 2 for specifying a display position (a discharge position). Then, the front electrodes, like the rear electrode row 5, are drawn out onto the rear glass 6 by connecting the metallic leads 3 independently for each terminal to the connecting electrode row 4 formed on the rear glass 6, whereby the transmission and reception of external signals are performed on only the rear glass 6. Where the front glass 1 and the rear glass 6 are to be sealed hermetically, the sealing glass 7 is applied to only the vicinity of the outer peripheral end portion on the rear glass 6 to effect the sealing.

The glass plate 8 provided on the front glass 1 as shown in FIGS. 5(*a*)–(*d*) and having through holes of the same pitch as that of the front electrode row 2 and also having the electrically conductive material 9 inserted in those through holes is sandwiched between the front glass 1 and the rear glass 6 under registration of the three of front electrode row 2, electrically conductive material 9 and connecting electrode row 4 to make electrical connection between the front electrode row 2 and the connecting electrode row 4, while the front electrodes are insulated from one another and the connecting electrodes also insulated likewise, and the front electrode row 2 is drawn out onto the rear glass 6. The glass plate 8 serves as a spacer between the front glass 1 and the rear glass 6 to maintain the spacing between the front and rear electrode rows 2, 5.

Using a concaved rear glass 12 formed by concaving the rear glass surface as shown in the embodiment of FIGS. 6(*a*)–(*c*), a rear electrode row 5 is formed in the concave portion of the rear glass in parallel with the thick portions on both sides of the concave. Further, a connecting electrode row 4 for drawing out the front electrode row 2 is disposed on the thick portions of the concaved rear glass 12, and the front glass 1 is mounted on said thick portions under positional registration of the electrode row to make electrical connection, thereby drawing out the front electrode row 2 onto the concaved rear glass 12 through conductive materials 10 and 11. Both thick side portions of the concaved rear glass 12 maintain the spacing between the front and rear electrode rows 2, 5.

Although in the above embodiments the metallic leads are drawn out of the sealing glass and connected to the connecting electrode row, this connection may be made inside the sealing glass.

Although in the above embodiments of FIGS. 5(*a*)–(*d*) an electrically conductive material is charged into the through holes formed in the glass plate, a predetermined thickness of material may be formed on the connecting electrodes to form electrically conductive connections.

Further, although in the above embodiments the front electrode row is drawn out onto the rear glass, the rear electrode row may be equivalently drawn out to the front glass side.

Thus, according to the above embodiments of the present invention all the connecting terminals of the display electrodes to the external power supply are gathered on the same side, and the sealing of glass can be done on one surface in a simplified shape, so there can be obtained a plasma display device easy to manufacture and high in both productivity and reliability.

Figure 7:
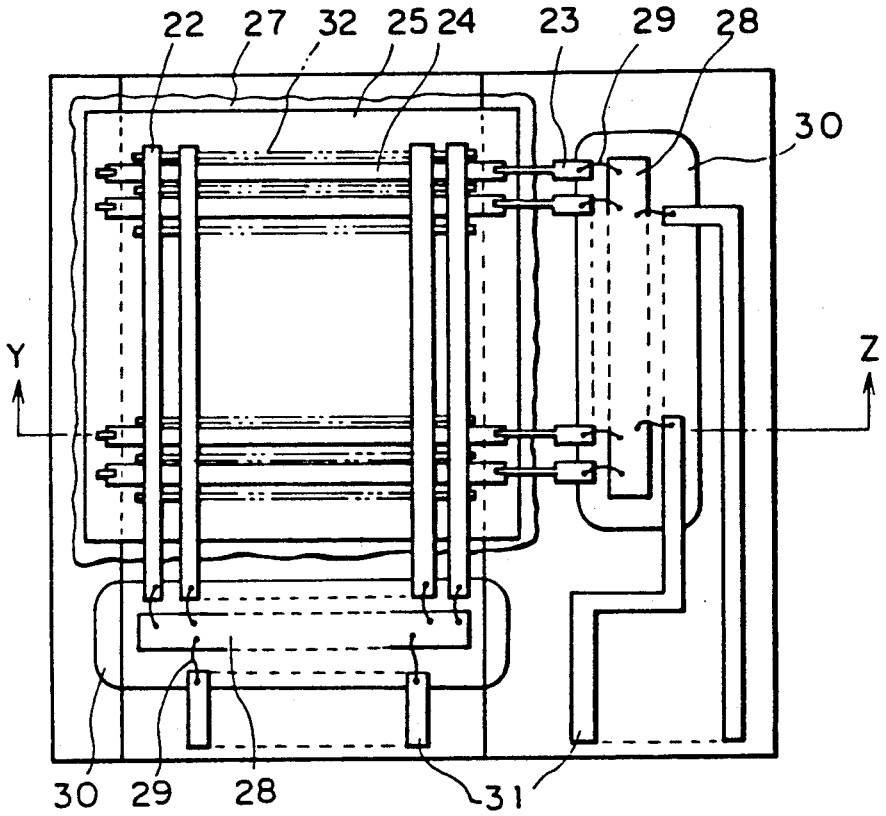
FIGS. 7(*a*) and (*b*) comprise a plan view and a sectional side view both showing a plasma display device according to a fourth embodiment of the present invention.
Figure 7:
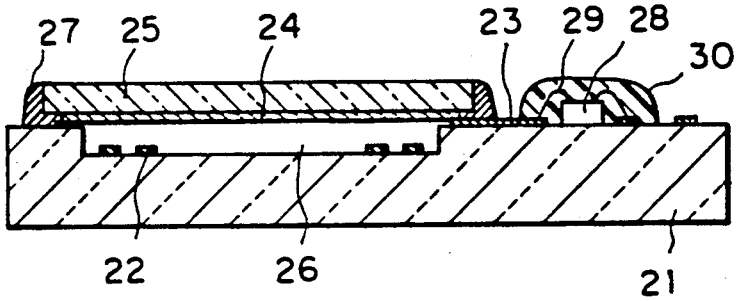

FIGS. 7(*a*) and (*b*) comprise a plan view and a side view of Y-Z section of a plasma display device according to a further embodiment of the present invention. In FIGS. 7(*a*) and (*b*), the numeral 21 denotes a two-stage substrate having upper and lower stages; numeral 22 denotes a conductor pattern (hereinafter referred to as the "lower-stage pattern") serving as an electrode row formed on the lower stage surface of the two-stage substrate 21; numeral 23 denotes a conductor pattern (hereinafter referred to as the "upper-stage pattern") serving as a terminal row for electrodes formed on the upper-stage surface of the two-stage substrate 21; numeral 24 denotes a conductor pattern (hereinafter referred to as the "cross pattern") serving as an electrode row formed on the lower surface of a member 25 in an orthogonal relation to the lower-stage pattern 22 so as to form a matrix; numeral 26 denotes a discharge gas to emit light which is sealed into the space between the lower-stage pattern 22 and the cross pattern 24; numeral 27 denotes a sealing member for sealing the gas 26 hermetically to the member 25; numeral 28 denotes a drive element, e.g. an IC chip, fixed to the lower- and upper-stage surfaces of the two-stage substrate 21; numeral 29 denotes a gold wire, say, 25 μm or so in diameter, for electrically connecting the lower- and upper-stage pattern 22 and 23 to their associated drive element 28; numeral 30 denotes a protective resin for protecting both the drive element 28 and the wire 29; and numeral 31 denotes an electrode terminal for connecting the drive element 28 to a.c. voltage supply, which electrode is formed by utilizing the remnants of end portions of the lower- and upper-stage patterns 22, 23. Further, numeral 32 denotes a rib for preventing the light emitted by discharge at an intersecting point of the matrix from being spread to other portions.

The operation of this embodiment will be described below. The light emitting operation of the plasma display device is the same as in the prior art, and so will not be explained here.

The space between intersecting points of electrodes of the matrix in FIGS. 7(*a*) and (*b*) corresponds to the difference in thickness between the upper and lower stages of the two-stage substrate 21 and is determined depending on the respective thicknesses.

Figure 8:
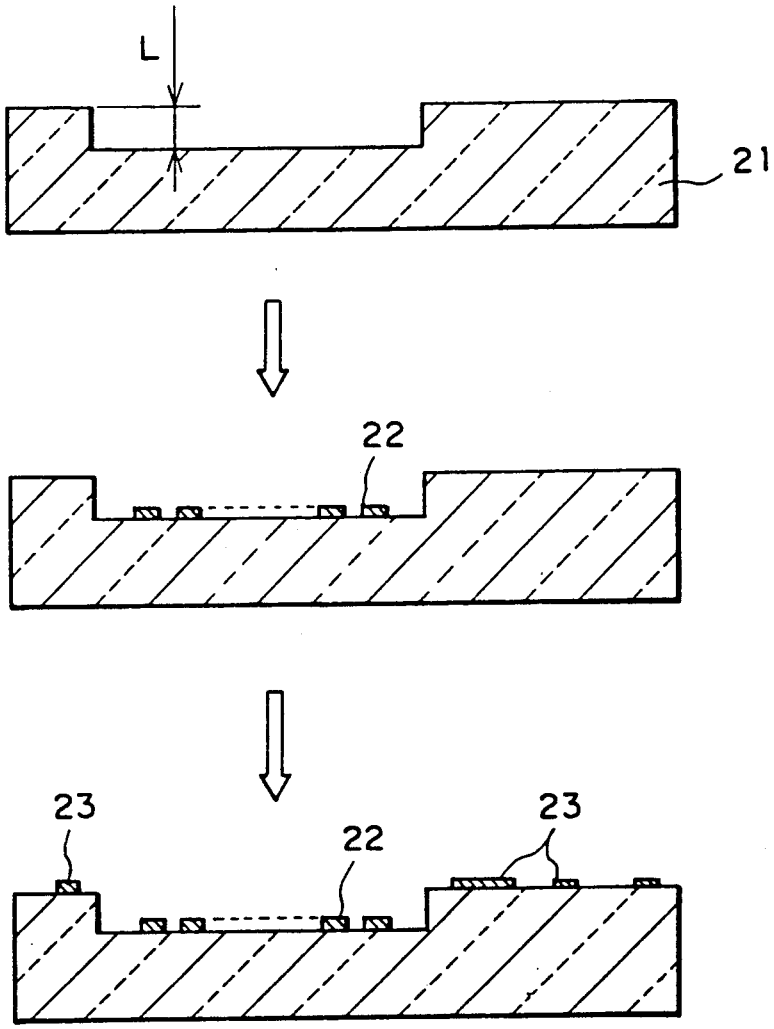
FIG. 8 is view showing steps for producing a stepped substrate in the embodiment of FIG. 7(*a*) and (*b* )

The method for producing principal components of the device of the embodiment shown in FIGS. 7(*a*) and (*b*) will now be explained. FIG. 8 shows the procedure by which the two-stage substrate 21 and the upper- and lower-stage patterns 22, 23 are produced. For example, a portion of a flat glass plate is shaved off at a height L, followed by polishing, then a conductor film is formed on the upper- and lower-stage surfaces of the two-stage substrate; for example, aluminum or nickel is adhered to those surfaces by sputtering or vacuum deposition at a thickness of −2 μm. Thereafter, a photoresist is applied onto the conductor film by a suitable method such as, for example, a dipping method, or using a roll coater or a pinner, followed by photomechanical etching to form a lower-stage pattern 22. Then, printing is made on the upper-stage surface using, for example, Ag paste, followed by drying to form an upper-stage pattern 23. The difference in height L is about 100 μm and it is possible to maintain the flatness of the lower-stage surface at a value not larger than 0.1 μm in terms of scatter in the polishing step. The conductor film becomes a little non-uniform in thickness at the stepped corner portions, so if the pattern is formed away from the stepped corner portions more than 1 mm or so, taking into account the portion where the lower-stage pattern 22 is to be formed, the conductor pattern film will have no difference in thickness.

The present inventors checked the influence of difference in height in photomechanical process. As a result, it turned out that even at a maximum difference in height of about 150 μm there could be obtained a pattern pitch of 300 μm, a pattern width of 200 μm and a pattern spacing of 100 μm.

Figures 9A, 9B:
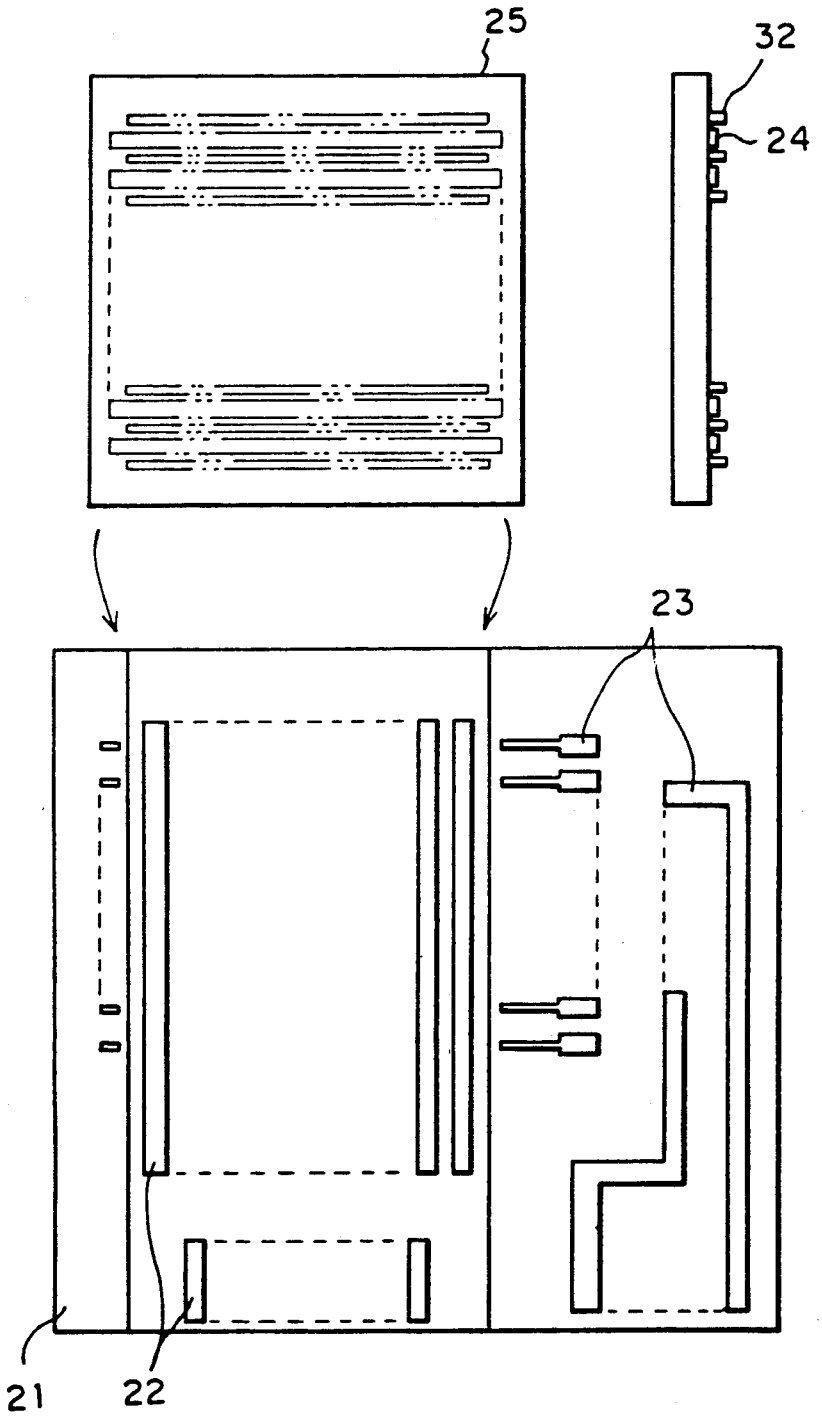
FIGS. 9(*a*) and (*b*) are is a plan views showing the relation between the two-stage substrate in the embodiments of FIGS. 7(*a*) and (*b*) and a separate transparent substrate.

On the other hand, the cross pattern 24 which intersects the lower-stage pattern 22 to form a matrix is formed by adhering it ITO film to a transparent material 25, e.g. glass, by sputtering or vacuum deposition, or applying $SnO_2$ thereto, followed by photomechanical etching. The cross pattern 24, which is a transparent electrode, serves as a pattern on the front glass side of the display device. Then, black paste is printed between cross patterns, followed by drying and calcining, to form ribs 32 as shown in FIGS. 9(*a*) and (*b*). The thickness of each rib 32 may correspond to a height which prevents the light emitted by discharge at an intersecting point between matrix electrodes from spreading to other portions. According to tests made by the present inventors, a rib thickness of about 40 μm is sufficient, permitting a reduced number of times of printing and reduced scatter in the thickness as compared with the prior art.

Then, the two-stage substrate 21 having the upper-stage patterns 23 formed thereon in a dried condition and the glass member 25 having the cross patterns 24 formed thereon are aligned as shown in FIG. 9(*a*) and (*b*), then put into a calcining furnace having a peak temperature of about 550° C. to calcine the Ag in the upper-stage pattern, thereby making electrical connection between the cross patterns 24 and the upper-stage patterns 23.

Then, a glass paste serving as a sealing material 27 and having a melting point of about 400° C. is applied from above to the over lapped portion of the two-stage substrate 21 and the member 25, followed by calcining in a calcining furnace having a peak temperature of about 400° C. to have the two-stage substrate 21 and the member 25 bonded and sealed together. Then, the interior of the thus-sealed space is evacuated using a vacuum pump through a pre-formed vent hole (not shown) to remove impurity components. Thereafter, a discharging gas 26 for the emission of light, e.g. Ne-Ar (99.8%: 0.1%) or Ne-Xe (99.8%: 0.1%), and a small amount of mercury (Hg) are charged into the thus-degassed sealed space and then the vent hole is sealed to thereby seal the gas 6 between intersecting electrodes.

Then, the lower-stage patterns 22 and the associated drive element 28 are wire-bonded together for electrical conduction using a gold wire of about 25 μm in diameter. Also, the upper-stage patterns 23 and the associated drive element 28 are wire-bonded together in the same manner. Thereafter, a protective resin 30, e.g. silicon resin, is applied so as to cover the gold wires 29 and the drive elements 28. The drawn-out electrodes 31 from the drive elements 28 may be provided beforehand in specific positions for the lower- and upper-stage patterns 22, 23.

Figure 10:
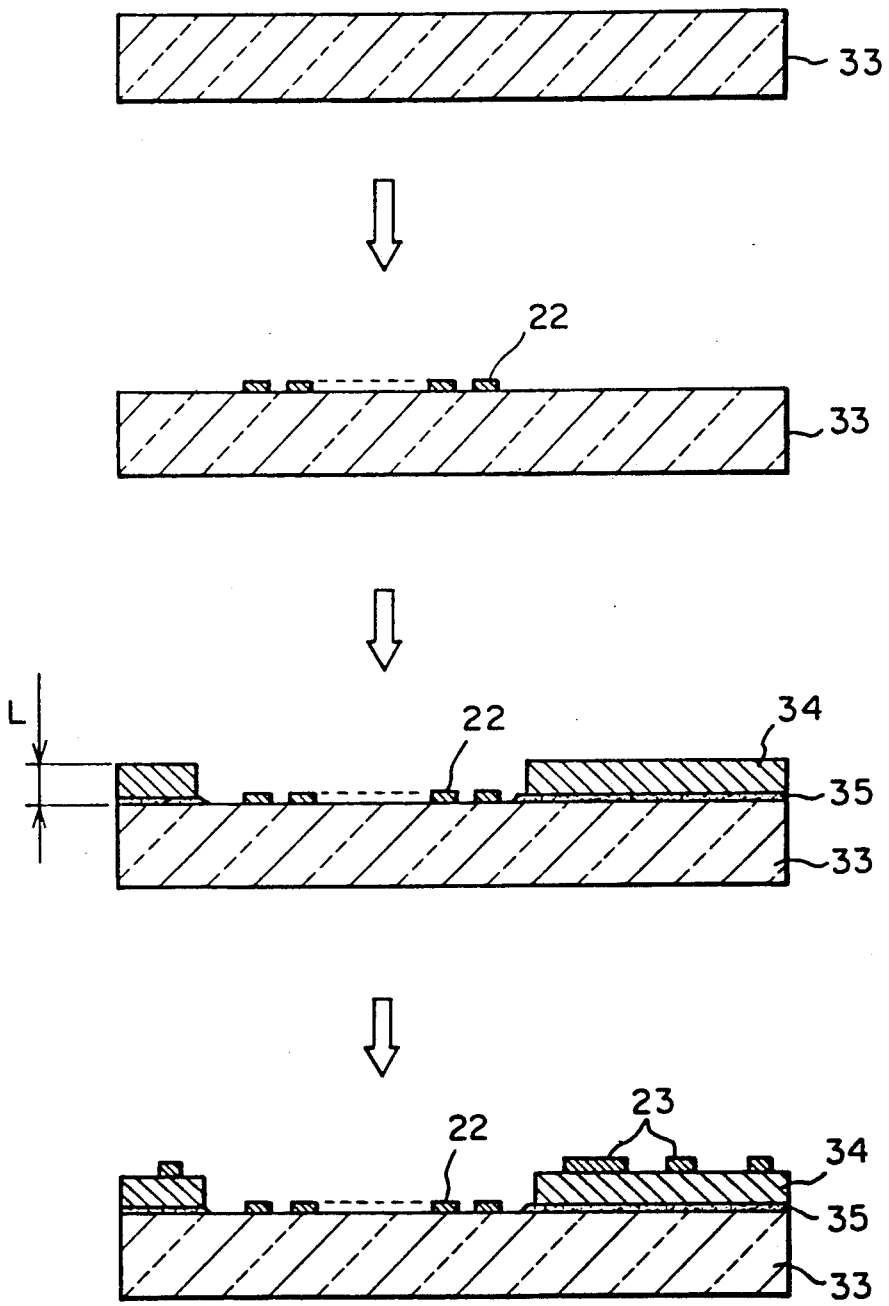
FIG. 10 is a view showing steps for producing a two-stage substrate according to a method of the present invention.

Although in the embodiment just described above there was adopted the method of shaving off a section of a glass plate to form the two-stage substrate 21, there may be adopted a method wherein, as shown in FIG. 10, two glass plates 33 and 34 are used and lower-stage patterns 22 are formed beforehand on the glass plate 33, then the glass plate 34 is bonded thereto using an adhesive 35, e.g. glass paste, and upper-stage patterns 23 are formed on the glass plate 34.

Although in the above embodiment the formation of the lower-stage patterns 22 and that of the upper-stage patterns 23 are performed separately, it is not necessary to do so if there is used a material for the electrodes which permits connection to the cross patterns 24, or the lower- and upper-stage patterns may be transparent electrodes, while the cross patterns may be other conductor electrodes. Also as to the ribs 32, they may be formed on the two-stage substrate 21 side.

Figure 11:
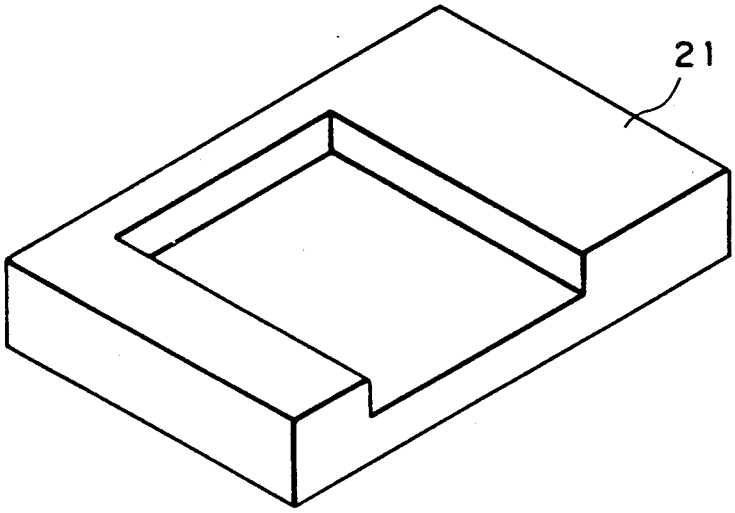
FIGS. 11, 12 and 13 are views each showing of a two-stage substrate as a modified embodiment of FIG. 7(*a*) and (*b*)
Figure 12:
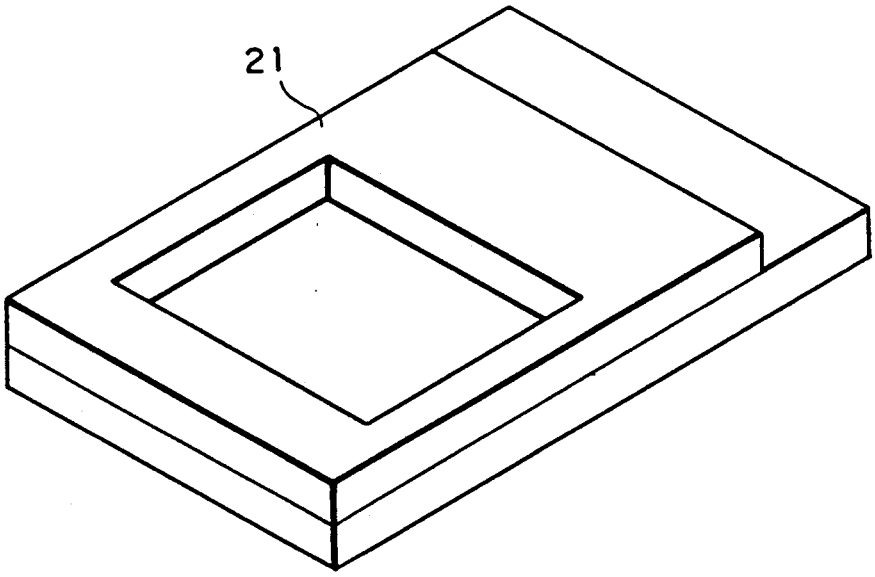

Further, as to the two-stage substrate 21, it may be such a substrate as shown in FIG. 11 or FIG. 12. The use of such illustrated substrates is effective in facilitating the sealing step.

Figure 13:
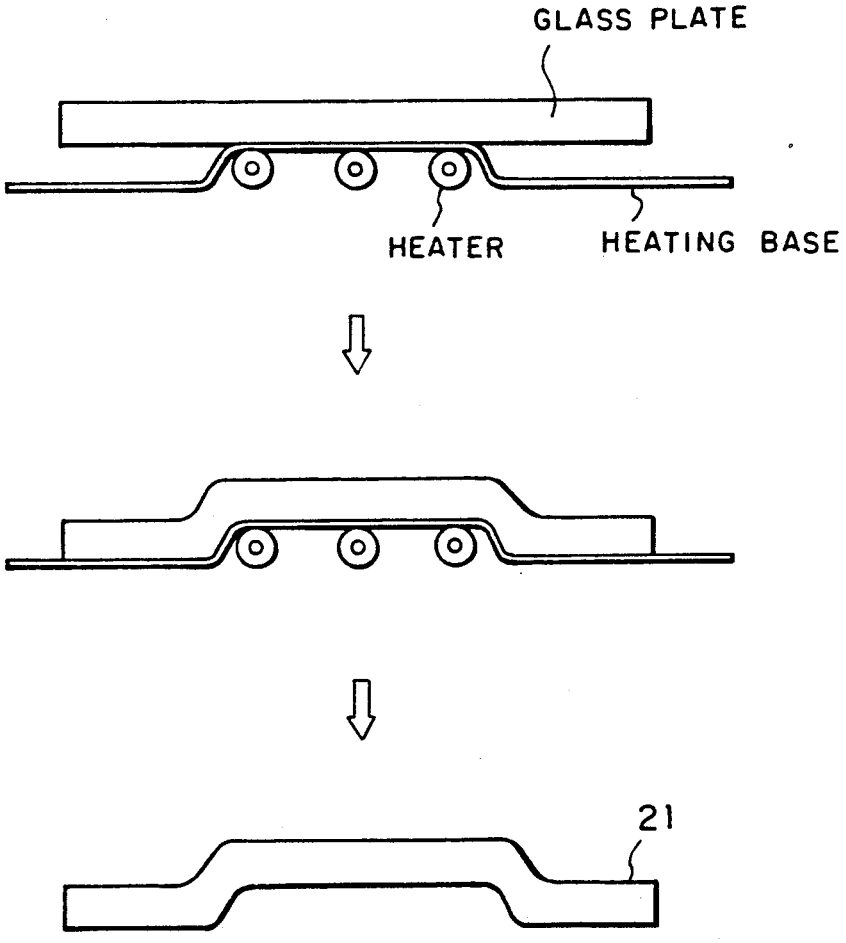

Further, there may be used a two-stage substrate obtained by forming a glass plate into a two-stage construction by heating as shown in FIG. 13. Also in this case there will be obtained the same effect as in the embodiment just described above.

Thus, according to the above embodiment of the present invention, using a two-stage substrate, patterns are formed on the lower-stage surface thereof and also on the upper-stage surface, then a member having patterns which intersect the lower-stage patterns in a matrix form is connected to the upper-stage surface electrically and mechanically, and a discharging gas for the emission of light is charged into the space formed by the two-stage substrate and the said member, then the said space is sealed hermetically and drive elements are mounted on the upper surface side of the substrate. By this construction, not only the performance of the plasma display device can be stabilized but also the size of the device can be reduced through easy sealing, mounting of drive elements on the substrate upper surface and specifying of the position of electrode connection terminals, thus leading to the improvement of the production yield and reduced cost of the plasma display device.

The following description is now provided for the method of producing the metallic leads used in the plasma display device of the present invention.

Figure 14:
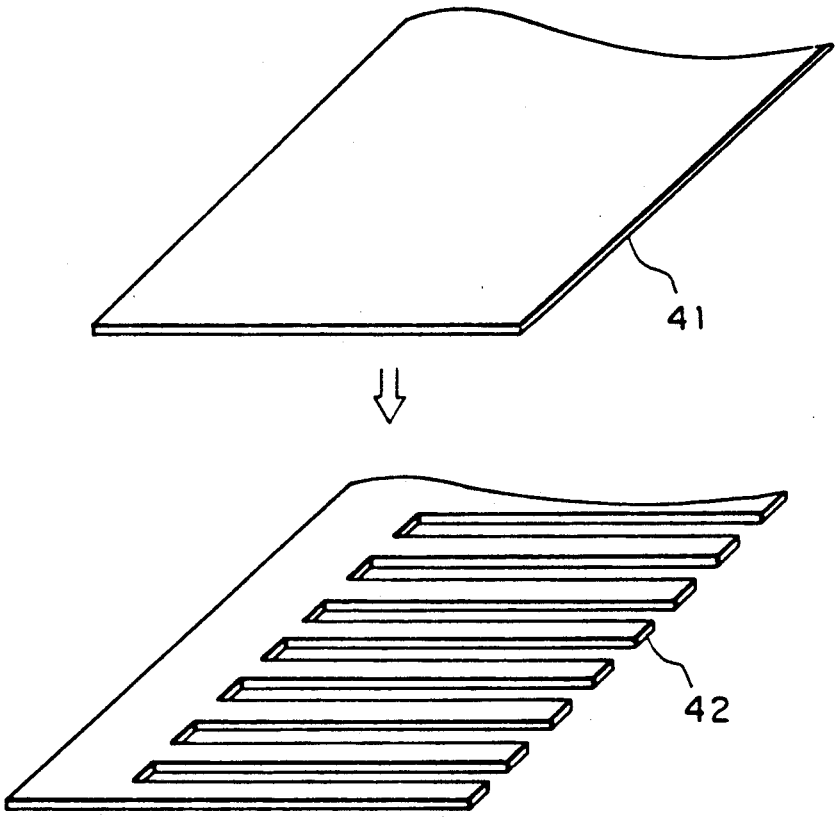
FIG. 14(*a*)–(*c*) are views showing a method for producing electrode leads according to another embodiment of the present invention.
Figure 14:
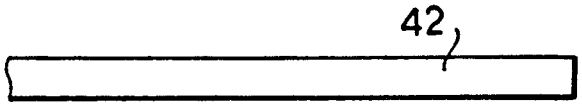
Figure 14:
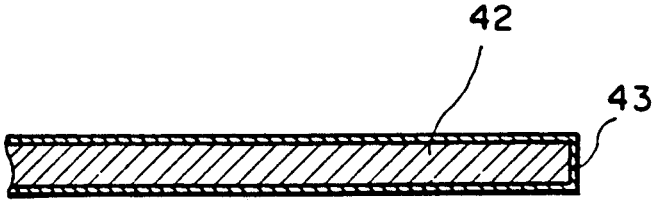

In FIGS. 14(*a*)–(*c*), the numeral 41 denotes a metallic plate of oxygen-free copper, brass or kovar; numeral 42 denotes a lead formed in the shape of a long strip of the same pitch as that of electrodes by etching of the metallic plate 41; and numeral 43 denotes a plating layer of nickel, silver, or an alloy thereof formed on the lead 42.

Figure 15:
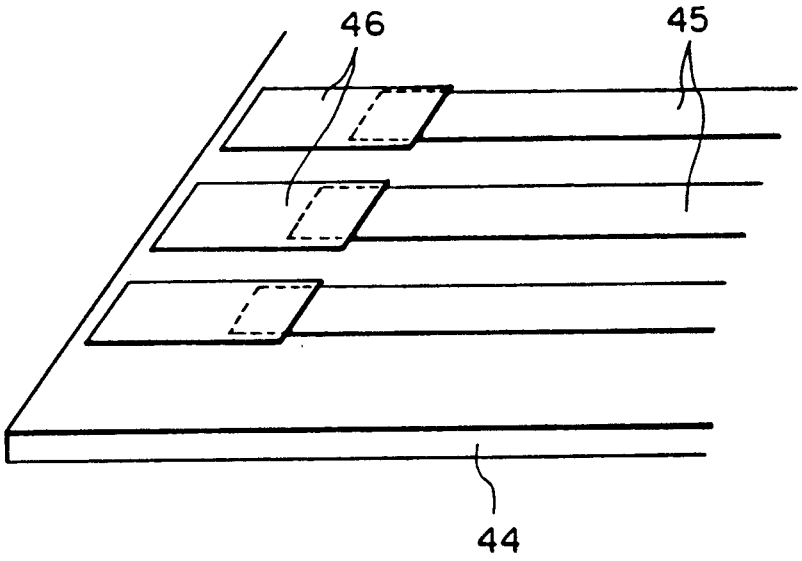
FIGS. 15(*a*) and (*b*) are views showing a terminal portion for mounting of the electrode leads.
Figure 15:
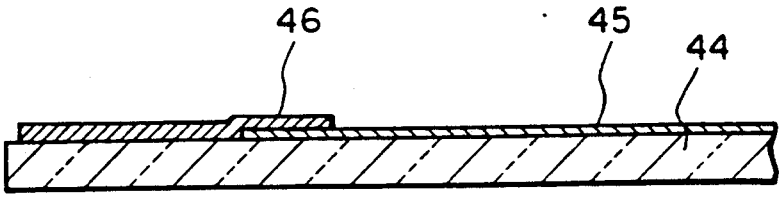

In FIGS. 15(*a*) and (*b*), the numeral 44 denotes a glass plate; numeral 45 denotes an ITO electrode row; and numeral 46 denotes a silver terminal for electrical connection with each ITO electrode to facilitate the mounting of the leads.

Figure 16:
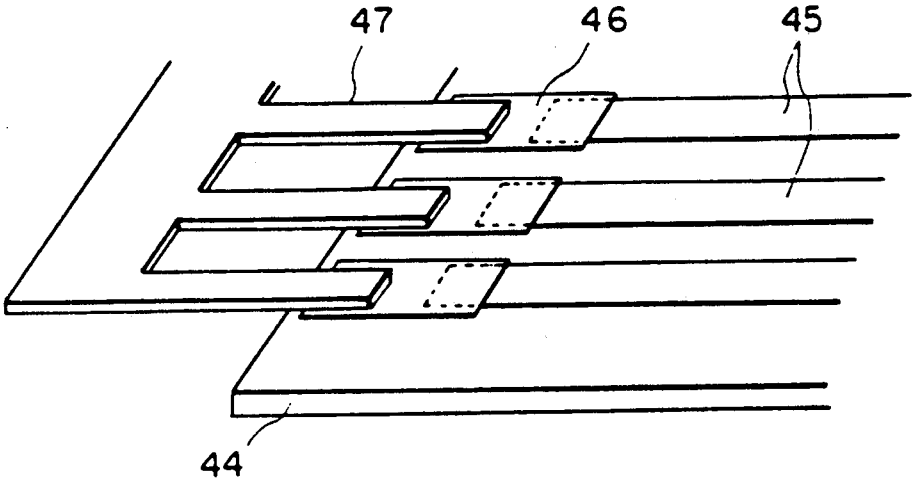
FIG. 16(*a*)–(*c*) are views showing a connecting step between the electrode leads and the terminal portion.
Figure 16:
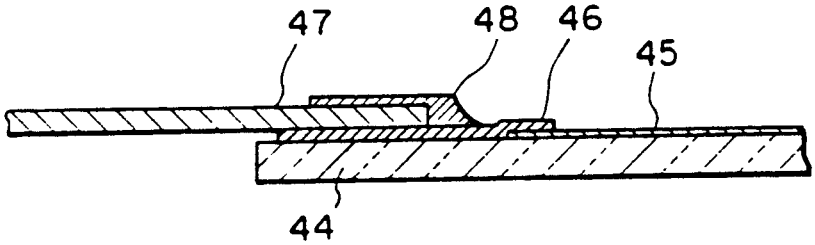
Figure 16:
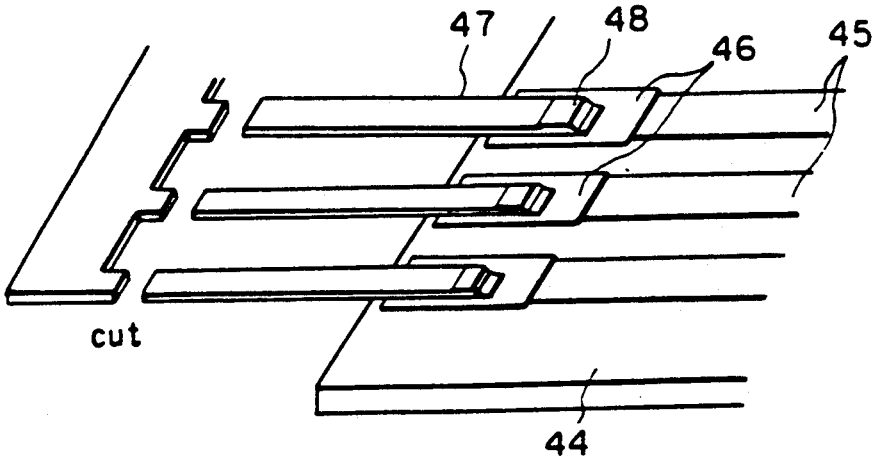

In FIGS. 16(*a*)–(*c*), numeral 47 denotes a plated metallic lead and numeral 48 denotes a silver paste which connects the metallic lead 47 and the silver terminal 46 together electrically and mechanically.

Operation will now be described. The metallic plate 41, having a predetermined thickness and constituted by oxygen-free copper, brass or kovar is subjected to an etching treatment to form the lead terminals 42 of the same pitch as that of the electrodes to be connected. Then, the lead terminals are plated with alloy 43 of Ni.x—Ag (1x); ($0 \leqq x \leqq 1$) to form metallic leads 47 to protect them from the heat applied thereto during the production of the display device. As a result, the connection between the electrode terminals 46 and the metallic leads 47 in the display device is effected in a stable manner.

Figure 17A:
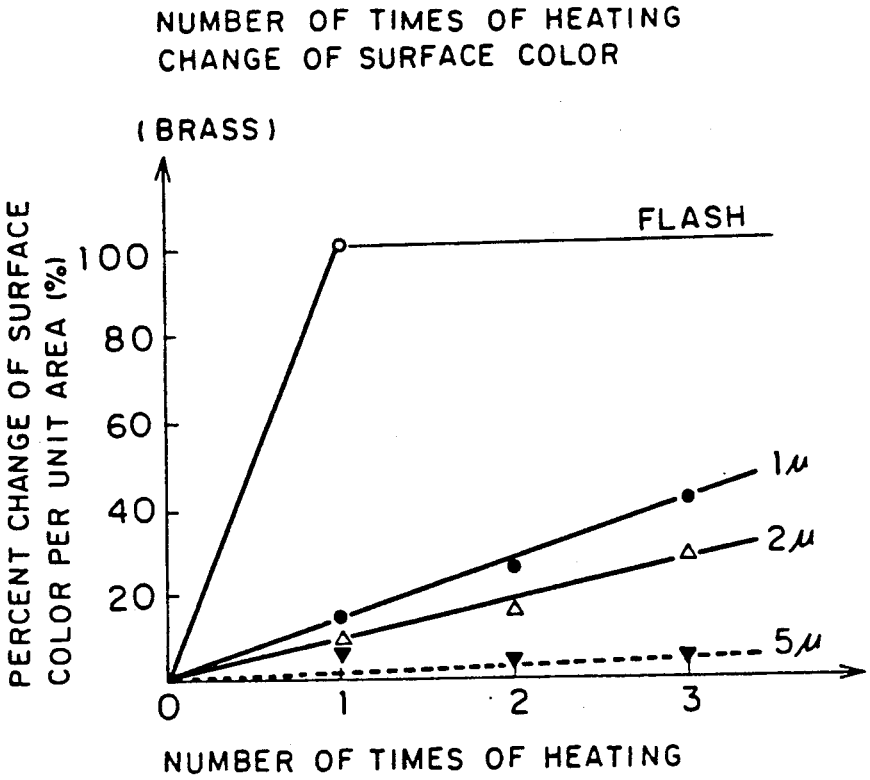
FIGS. 17(*a*)–(*d*) and 18 are graphs each showing the results of an experiment conducted to check the relation between metallic leads and heat stress with plating thickness as a parameter.
Figure 17B:
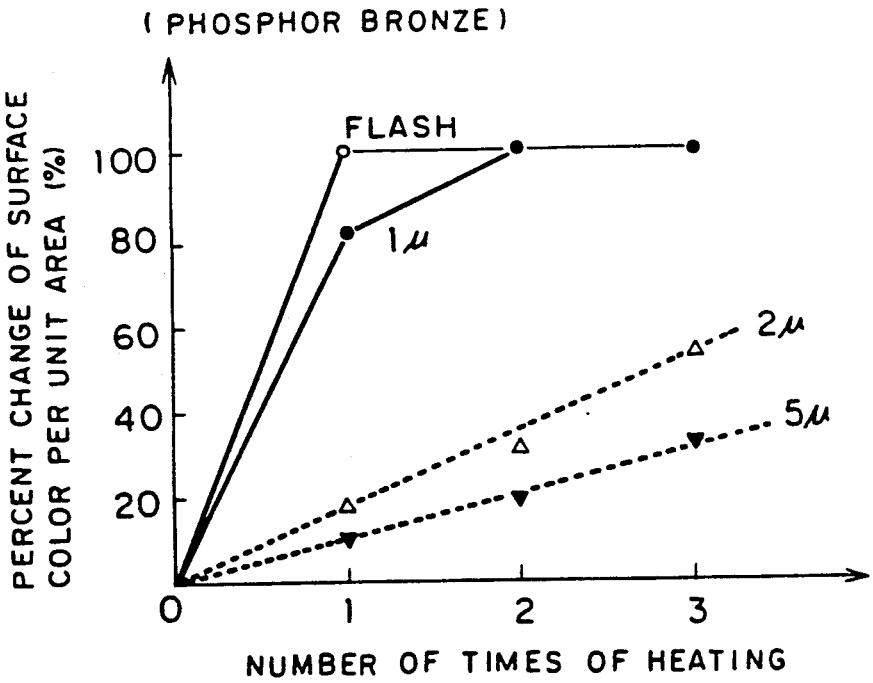
Figure 17:
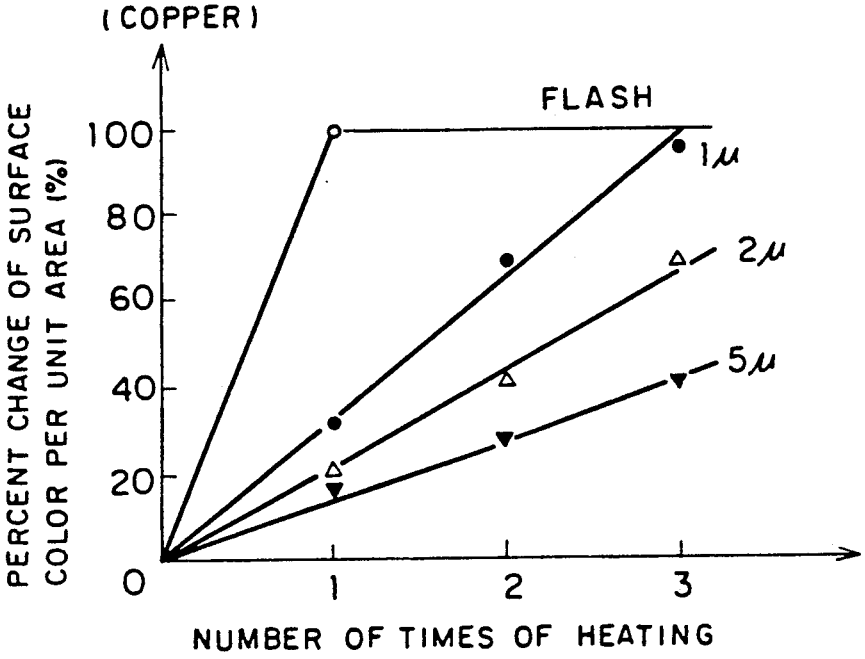
Figure 17:
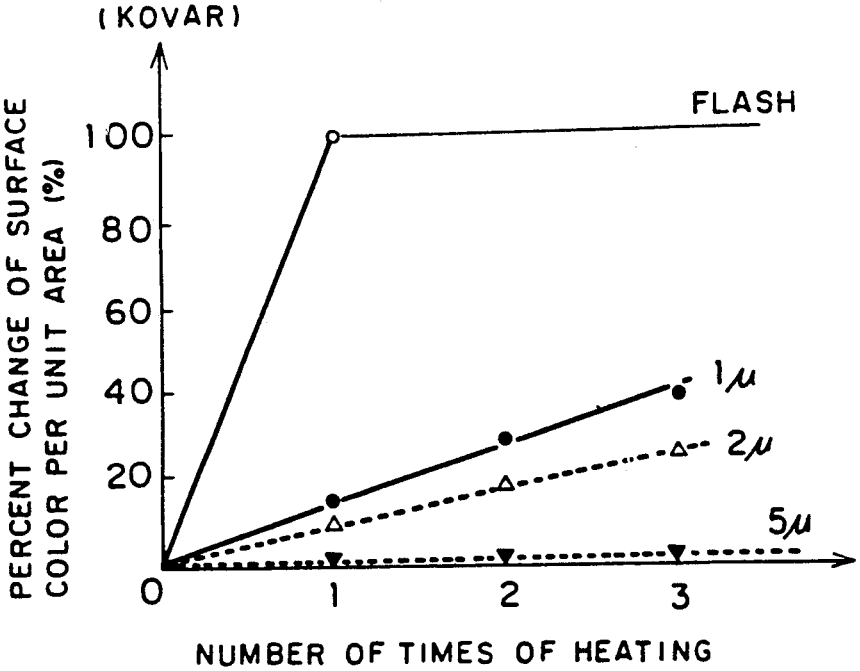
Figure 18:
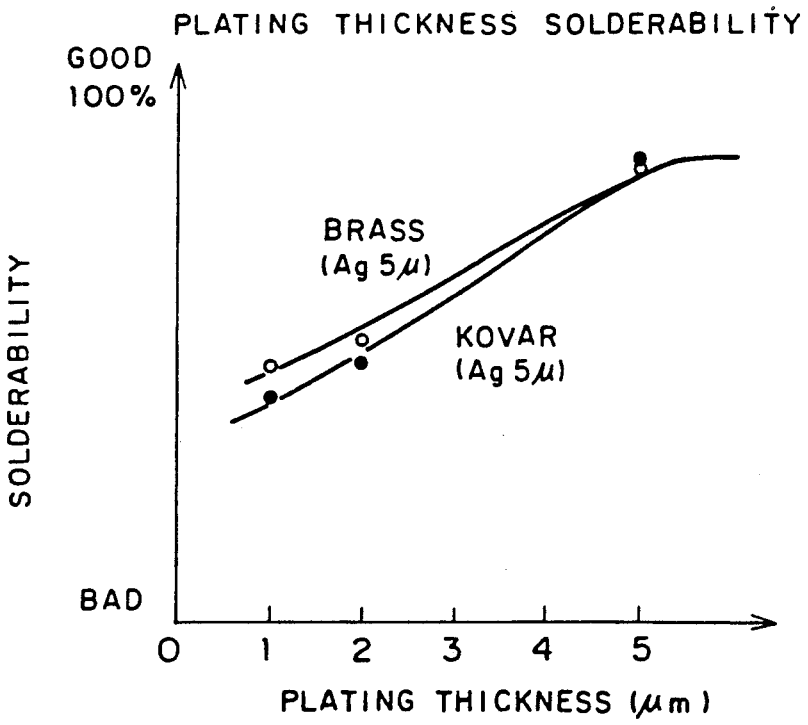

Using phosphor bronze, copper (oxygen-free copper), kovar and brass as metallic materials, the present inventors plated the surfaces of these materials with Ni-Ag. In the course of production of the display panel, the metallic leads are connected to the electrode terminals on the glass plate, then heat stress of about 500° C. is applied thereto two or three times. Therefore, the heat resistance and the surface condition after the heating of the metallic leads, close adhesion of the electrode terminals and the metallic leads, and the solderability of the metallic leads are mentioned as important parameters to be considered. To check these items, particularly the following points, the present inventors conducted the following experiments:

(1) Change of the metallic surface caused by heat stress with change in plating thickness
(2) Solderability after heat stress
(3) Exfoliation of plating after heat stress. The results of the experiments are as shown in FIGS. 17(*a*)–(*d*) and 18.

The above (2) and (3) were checked in the same test. The thicker the surface plating layer of the metallic leads, the more stabilized the surface condition. Also as to solderability and exfoliation of plating, the thicker the plating layer, the better the results. Brass or kovar is used as a base material of the metallic leads and plated with silver (Ag) so as to give a plating layer thickness not smaller than 5 μm, whereby there are obtained metallic leads stable in surface condition even after heat stress and superior in solderability. There is also attained the feature that the metallic leads formed by plating the surface of the metallic base material with silver are well compatible with the silver which forms the electrode terminals and superior in close adhesion.

On the other hand, the ITO electrode row is difficult to bond to other metals, so terminals are formed on the ITO electrodes by calcining and fixing, using a highly bondable silver paste, to facilitate drawing-out of the electrodes. For bonding the metallic leads onto the silver terminals, the silver paste is further applied onto the silver terminals and the metallic leads are pressed for bonding while the silver paste still has viscosity, followed by calcining. In this way there is made connection between the metallic leads and the ITO electrodes. Further, by cutting the common portions of the metallic lead row there are obtained independent leads for drawing out the electrodes.

Although in the above embodiment of the metallic lead producing method the leads were formed for drawing out the ITO electrodes on the front glass, leads may be drawn out from any other electrode row than the above, or the electrode row on the rear glass may be drawn out to the front glass side.

Thus, according to the metallic lead producing method in the plasma display device of the present invention, there are obtained metallic leads which, after being bonded to the electrode drawing-out terminals, exhibit little change in the surface condition even under multiple applications thereto of heat stress and are superior in solderability. Further, the drawing-out of electrodes for conduction from the display electrode row is performed by attaching lead terminals to electrode ends, and between the lead terminals and the electrodes there are provided silver terminals for lead bonding, whereby the stability and reliability of the bonding strength in the lead bonding are improved to afford a highly reliable display device.

What is claimed is:

1. A plasma display device, comprising:

a first transparent substrate having a plurality of linear electrodes arranged thereon in parallel in a first direction;

a second transparent substrate having a plurality of linear electrodes arranged thereon in parallel in a second direction orthogonal to said first direction;

said first and second substrates being hermetically sealed together to form a discharge space therebetween with said electrodes intersecting to form a display matrix;

a discharge gas sealed within said discharge space for emitting a visible plasma discharge when a predetermined driving voltage is applied between intersecting electrodes;

a plurality of electrode connector terminals positioned along the peripheral edge portions of said first substrate for connection to an external a.c. driving voltage;

connector means extending between said first and second substrates and electrically connecting said plurality of electrodes arranged on said second substrate to respective ones of said electrode connector terminals positioned on said first substrate;

means for providing an external a.c. driving voltage to said plurality of electrodes on said first substrate; and wherein said connector means comprises a spacer member having a plurality of through-holes for enabling communication between said electrode connector terminals and corresponding electrodes of said second substrate, said through-holes being filled with electrically conductive material for electrically connecting said electrode connector terminals to said electrodes of said second substrate.

2. A plasma display device according to claim 1 wherein said spacer member further forms means for spacing apart said first and second substrates to form said discharge space therebetween.

* * * * *

UNITED STATES PATENT AND TRADEMARK OFFICE

CERTIFICATE OF CORRECTION

PATENT NO. : 5,107,176

DATED : April 21, 1992

INVENTOR(S) : Takafumi Endo et al.

It is certified that error appears in the above-identified patent and that said Letters Patent is hereby corrected as shown below:

Column 2, lines 60-61, "abovementioned" should be --above-mentioned--.

Column 4, line 42, delete "a";
line 44, "FIG." (second occurrence) should be --FIGS.--;
line 50, after "4(a)" delete the comma ",";
line 63, after "is" insert --a--;
line 65, delete "is a".

Column 5, line 5, "FIG." should be --FIGS.--;
line 7, "FIG." should be --FIGS.--;
line 12, "FIG." should be --FIGS.--;
line 25, "FIG." should be --FIGS.--.

Column 7, line 44, "-2" should be -- 2 --.

Column 8, line 20, "FIG." should be --FIGS.--.

Signed and Sealed this

Twenty-first Day of September, 1993

Bruce Lehman

*Attest:*

BRUCE LEHMAN

*Attesting Officer*

*Commissioner of Patents and Trademarks*